US005983823A

United States Patent [19]

Allison

[11] Patent Number: 5,983,823

[45] Date of Patent: Nov. 16, 1999

[54] HIGH SPEED SPORT/UTILITY BOAT

[76] Inventor: Darris E. Allison, 106 Main St., Louisville, Tenn. 37777

[21] Appl. No.: 09/102,240

[22] Filed: Jun. 22, 1998

[51] Int. Cl.[6] ..... B63B 1/00

[52] U.S. Cl. ..... 114/271; 114/56.1

[58] Field of Search ..... 114/271, 56.1, 114/274, 283, 292, 291, 288

[56] References Cited

U.S. PATENT DOCUMENTS

| | | | |
|---|---|---|---|
| D. 358,122 | 5/1995 | Perette . | |
| 3,117,544 | 1/1964 | Schoell . | |
| 4,022,143 | 5/1977 | Krenzler . | |
| 4,128,072 | 12/1978 | Wood, Jr. . | |
| 4,233,920 | 11/1980 | Wood et al. . | |
| 4,453,489 | 6/1984 | Charlins . | |
| 4,492,176 | 1/1985 | Arima . | |
| 4,584,959 | 4/1986 | Allison . | |
| 4,619,215 | 10/1986 | Wood et al. . | |
| 4,958,585 | 9/1990 | Caldwell, Jr. . | |
| 5,046,439 | 9/1991 | Goodson et al. . | |
| 5,063,868 | 11/1991 | Fink, Jr. | 114/271 |
| 5,390,624 | 2/1995 | Barnes . | |
| 5,443,026 | 8/1995 | Wenstadt et al. . | |

*Primary Examiner*—Stephen Avila
*Attorney, Agent, or Firm*—Luedeka, Neely & Graham, P.C.

[57] ABSTRACT

An improved V-bottom hull for sport/utility boats is formed with intermediate lifting strakes along the aft half of the hull bottom. Such intermediate strakes are positioned laterally along the boat bottom between the planing pad step and the chine. These intermediate strakes are proportioned to provide a strake riser face width that is about 1 in. or greater and a horizontal tread width of the strake of less than about 3 in. An included angle between the tread surface and the riser face is preferably between about 95° to about 110°. The riser face intersection with the adjacently higher bottom surface panel is faired with a longitudinal fillet.

16 Claims, 6 Drawing Sheets

HIGH SPEED SPORT/UTILITY BOAT

This invention relates to construction forms for high speed sport/utility boats. In particular, the present invention relates to the construction and shape parameters for the hull bottoms of such boats.

High speed sport/utility boats, those capable of 80 to 120 mph or more, are often constructed with a modified V-bottom having a relatively narrow planing pad extending longitudinally along the hull bottom. By some references, the planing pad is characterized as a keel pad since it is the bottom-most surface structure along the longitudinal center plane of the vessel at the stem end.

The planing pad is a relatively narrow surface extending forward from the boat transom. Along the intersecting edges with the transom plane, the planing pad is usually given a very shallow or nearly flat transverse arc. The pad is laterally delineated symmetrically by substantially parallel steps having longitudinal riser faces. An edge intersection between the planing pad and the transom is preferably abrupt. From the transom, the planing pad progresses forwardly toward the bow with a diminishing transverse arc radius that is smoothly distributed along the hull's length.

This planing pad functions much like a water ski to support the boat weight on the water surface by hydrodynamic pressure. At high speed, 100 mph for example, a 20 ft. boat that weighs about 2500 lb. and has this type of hull may ride entirely, or almost entirely on less than 1 to 2 ft.$^2$ of planing pad surface forward of the transom. Hence, the speed and control of this type vessel at maximum planing speed is largely dependent upon both the hydrodynamics and aerodynamics of the hull bottom surface. Roll stability is almost entirely aerodynamic with inherently corrective surface effect forces generated by ram air into chine tunnels along both sides of the boat. Pitch stability is obtained by a combination of both aerodynamics and hydrodynamics.

In a stationary status, a displacement hull vessel is entirely supported by the static result of displacing a volumetric quantity of water corresponding to the weight of the boat. With only relatively modest engine power driving a hydraulic propeller, a sport/utility boat transposes the hull from this immersed, static displacement mode to the nearly airborne dynamic mode in progressive increments. From the initial application of power to the propeller, the boat hull is thrust forward through the supporting water body. Water that is displaced by the hull advancement is pushed both forwardly and laterally. Simultaneously, the energy transferred to the displaced water pushes the displaced volume upon the hull surface above the water body surface. As the boat speed increases and dynamic impulse forces correspondingly increase against the wetted hull bottom, the V shaped hull responds to the increased surface pressure against the hull bottom by rising on the water body surface to displace less water volume. However, this reduced volume is displaced is more forcefully. The added displacement force sprays the water upwardly along the hull bottom and wets the boat hull above the dynamic waterline with a heavy coating of water that adds to the hull weight and generates parasitic drag.

The prior art has developed lifting strakes to separate the speed displaced water volume from the hull bottom surface. Lifting strakes are narrow, elongated platforms or ridges that extend along the hull bottom between the planing pad edges and the boat chine. There is no predetermined number of strakes between the planing pad and the chine but, generally, there are one to four such strakes laterally from each planing pad riser face. These strakes divide the hull bottom into two or more bottom panel sections.

As a general configuration, at any given transverse station of a prior art hull the bottom panel sections will be aligned in a common deadrise angle. The deadrise angle, generally, is that angle given to the hull bottom plane relative to the horizontal. The reference plane is horizontally transverse of the boat length. The deadrise angle usually changes progressively along the boat length from bow to stern. Continuity of the deadrise plane alignment is usually interrupted only by the strakes.

The cross-sectioned geometry of the strakes is generally a right triangle step with an approximate 90° base angle between the step rise and the step tread. The step tread is the lower, horizontal surface of a strake whereas the step riser is the vertical surface. Traditional bottom deadrise angles for high speed sport/utility boats near the stem has ranged from about 12° to about 24°. As measured near the bow, the deadrise angle may be about 45°. The geometric realities of a prior art lifting strake therefore are that the horizontal tread width will usually be wider than the strake riser width. Theoretically, it is the abruptly intersecting edge between the strake tread surface and the riser surface that separates the rising displacement water from the boat hull. Once the strake outer edge rises above the water body surface, displacement water flowing laterally across the strake tread will separate from the hull surface along the strake edge. When relieved of the weight and drag of such displacement water, the boat accelerates and rises to the next lower strake increment. However, unless the surface of the strake riser has a height of at least about 1 in., for example, upwardly expanding spray off the strake edge impinges upon the next higher bottom panels and reattaches.

It is an object of the present invention, therefore, to provide an improved V-bottom hull shape for high speed sport/utility boats.

Another object of the present invention is a more efficient V-bottom hull shape for boats.

Yet another object of the present invention is a more effective boat hull strake configuration.

Still another object of the invention is to provide a boat hull strake that enables a more compliant skid response.

Also an object of the present invention is to provide a boat which achieves a greater speed from the predetermined power source.

Another object of the invention is to provide a boat design that attains maximum speed more quickly than a prior art boat design.

A still further object of the invention is an increased load support capacity by increasing the dynamic lift: drag ratio.

Another object of the invention is a reduced turning circle that may be executed at high speed.

SUMMARY OF THE INVENTION

These and other objects of the invention as will become apparent from the following description of the preferred embodiments are achieved on V-bottom boat hulls by the means of one pair or more intermediate lifting strakes along the stern portion of the boat length positioned substantially symmetrically on each side of the hull longitudinal/vertical center plane. More definitively, intermediate strakes are located between the planing pad and the chine. Strakes, generally, are defined by a substantially horizontal tread surface plane and a riser face plane. The plane of the riser face for the invention intersects with the tread surface plane at an included angle of about 95° to about 110°. Preferably, the invention riser face plane width is about 1 in. or more and about 120% to about 200% greater than a prior art riser face width corresponding to normal deadrise angles.

The upper root of the riser face fillets into the plane of the adjacently higher bottom panel section to smoothly direct reverse flow water over the hull downwardly off the strake edge. Such reverse flow water occurs in the event of abrupt turns or large waves traveling transversely of the boat movement direction. Resultantly, turns of less turning circle diameter may be safely executed at high speed.

BRIEF DESCRIPTION OF THE DRAWINGS

The present invention may be best understood by reference to the following Description Of The Preferred Embodiments when considered in conjunction with the drawings in which.

DESCRIPTION OF THE PREFERRED EMBODIMENTS

Figure 1:
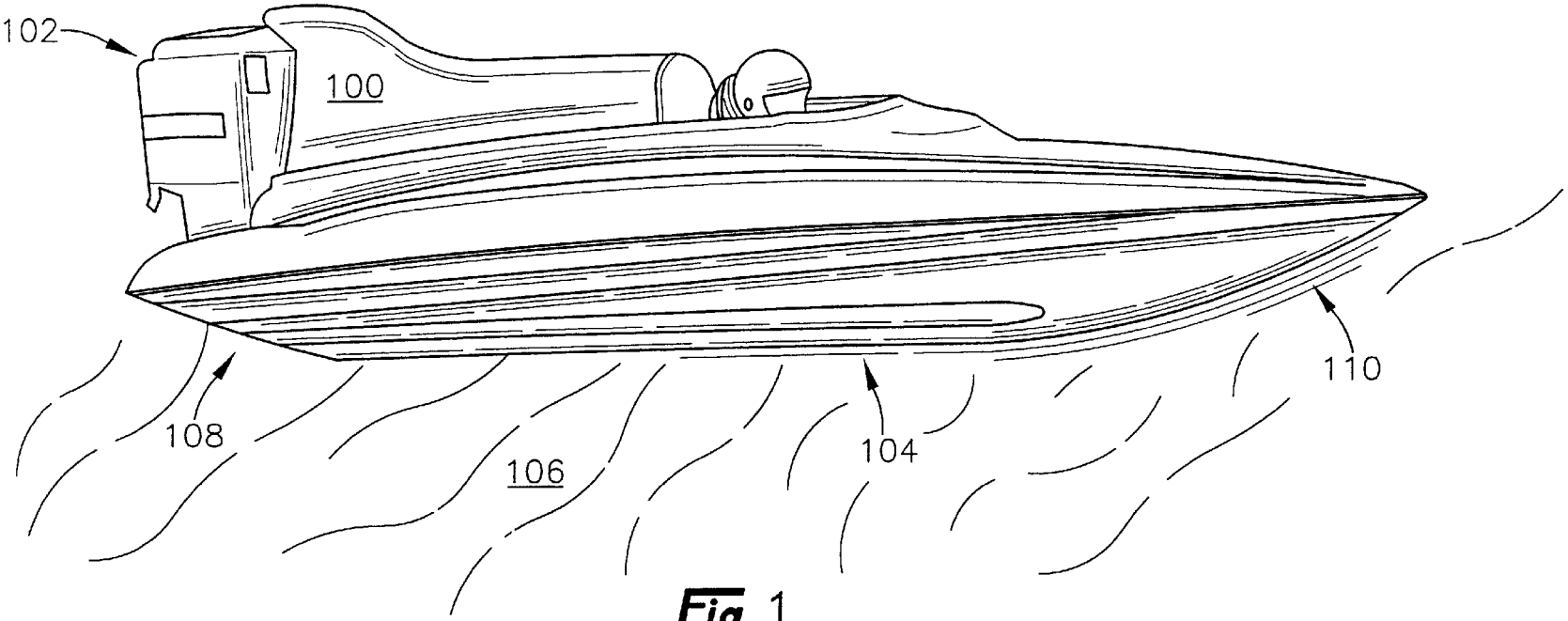
FIG. 1 is a pictorial of a sport/utility boat planing near maximum speed.

Referring to the drawings in which like reference characters designate like or corresponding elements throughout the several views, FIG. 1 illustrates a sport/utility boat 100 shown in a high speed planing position. An outboard engine 102 drives the boat about 90 mi/hr to about 120 mi/hr. Alternatively, the boat may be driven by a stern drive unit (not shown) which is characterized by having an engine positioned forward of the boat transom. In such a configuration, an upper drive shaft penetrates the transom to drive an outboard propeller unit behind the transom.

Of particular note from FIG. 1 is the fact that the only contact made by the modified V-bottom of the boat hull 104 with the water running surface 106 is an extremely small area at the bottom center of the boat stern 108. The bow 110 of the boat is airborne by the oncoming ram air and the consequential ground effect pressure between the forward bottom surface of the hull 104 and the water running surface 106.

Figure 2:
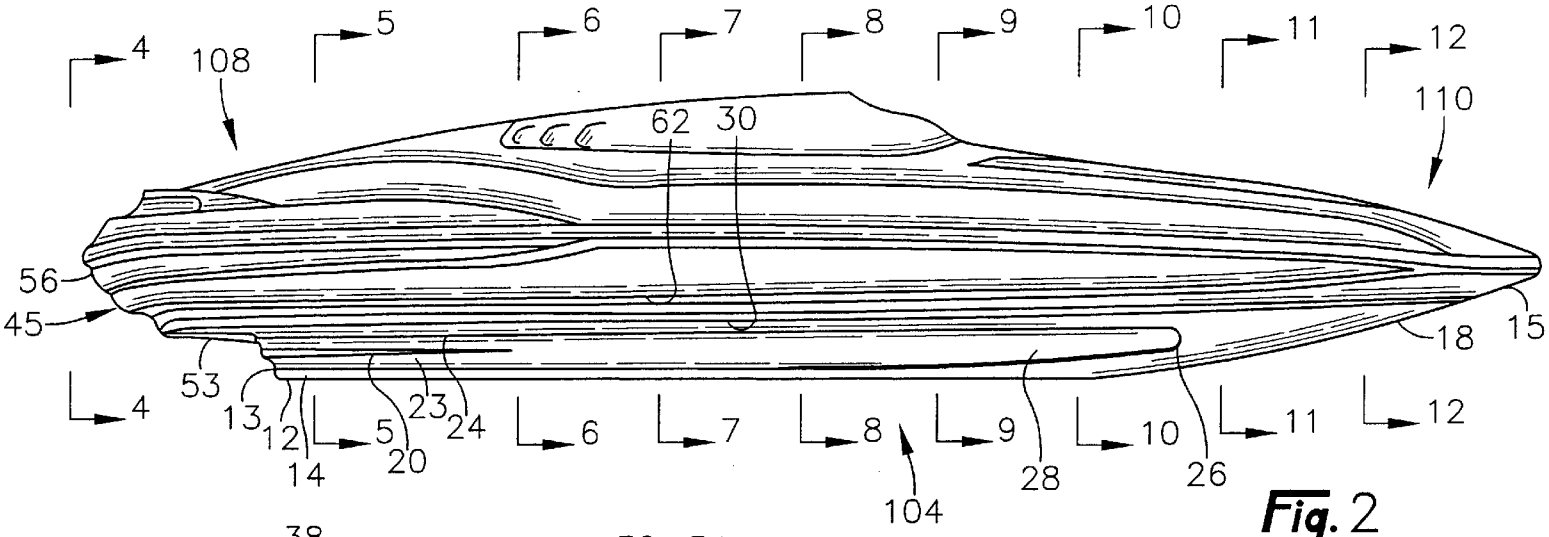
FIG. 2 is a side elevational view of a boat hull constructed in accordance with the present invention.

FIG. 2 also illustrates the hull 104 as constructed in accord with the present invention but in the orthographic detail of a side elevational view.

Figure 3:
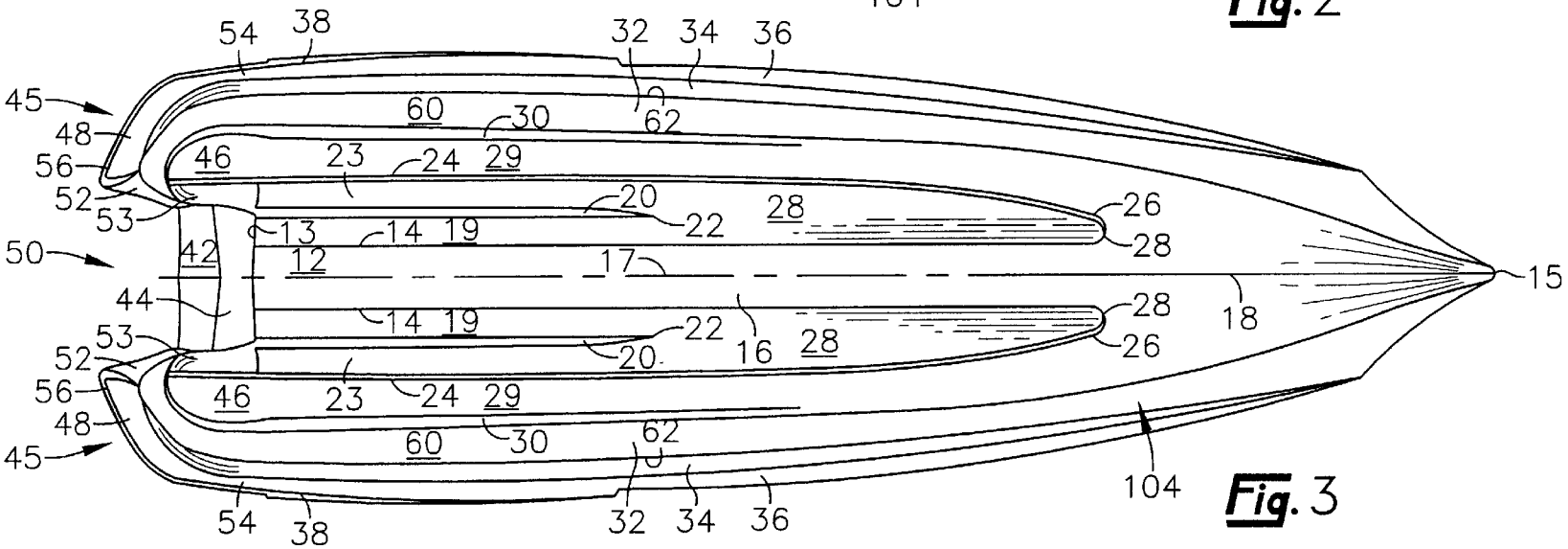
FIG. 3 is a bottom plan view of a boat hull constructed in accordance with the present invention.

FIG. 3 shows the orthographic bottom plan view of the hull 104 which is preferably constructed of fiberglass but may be constructed of any suitable material. The hull 104 depicted is a twenty foot model, but the design principles are suitable for a wide variety of boat sizes and may be used on other types of planing hulls such as catamarans.

With respect to FIGS. 1 and 2 when considered together, the hull 104 includes a stepped planing pad 12 to form the lowermost center of the hull stern 108. The pad 12 extends forwardly along the hull centerline (keel line) 17 from the lower transom edge 13 toward the boat bow 15. At the lower transom edge 13, the planing pad 12 is substantially flat with a long radius arc or has a large dihedral angle greater than 170°. As the pad surface progresses forwardly to about midship 16, the dihedral angle about the centerline 17 diminishes at a distributed rate into the cutting edge 18 of the bow keel.

Planing pad 12 is laterally delineated on opposite sides of the centerline 17 by steps 14 that are, generally, an abrupt, vertical face separation between the planing pad surface and the adjacent bottom panels 19. The plane of the panels 19 is set at an angle to the horizontal that rises from the bottom center toward the chines 32. Strakes 20 are generally parallel with the planing pad 12. Additionally, paired strakes on either side of the boat center are substantially coplanar. A more expanded description of the angle at which the V-bottom panels rise will be subsequently provided.

It should be understood that geometric descriptions such as "horizontal", "vertical", "longitudinal", "above" and "below" are used as convenient terms of reference and are not to be given absolute interpretation.

The longitudinal upper boundaries for the panels 19 are a first pair of intermediate lifting strakes 20. Representatively, lifting strakes have at least two distinct functions, neither of which is less important than the other. One function is to provide a narrow, flat band of surface that is effective for hydrodynamic planing support. The other dominant strake function is to separate lateral flow displacement water and spray from the hull surface. The length of strakes 20 is truncated at a point 22 about a third to half of the distance from the lower transom 13 to the point of the bow 15.

A second pair of intermediate lifting strakes 24 provides the upper longitudinal boundaries for the V bottom panels 23. These strakes 24 also are coplanar and generally parallel to the horizontal. The horizontal planarity of the strakes 24 continues with a forward projection into a curved merger 26 with the planing pad steps 14. Substantially planar V bottom panels 28 are formed between the planing pad step 14 and the second lifting strake 24 forward of the first strake 20 termination point 22.

The third water shed edge 30 is a lower chine edge and provides the horizontally outer delineations for a third pair of V bottom panels 29.

Up from the chine edge 30 are concave channel surfaces 60 that are terminated along relatively sharp upper chine edges 62. Collectively, the concave surface 60 and edges 62 are characterized as a tunnel chines 32. Shaped as a gull-wing, a transverse upward and outward curve in the tunnel chines 32 is projected longitudinally from the hull stern toward the bow. As the tunnel chines approach the bow, they curve inwardly and expand. It will subsequently be described in greater detail that the tunnel chines 32 function as gull wings to lift and stabilize the hull at planing speeds.

Figure 4:
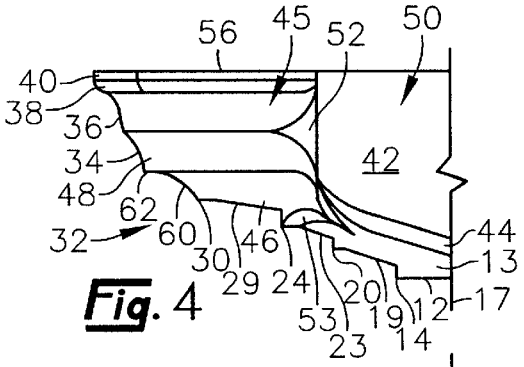
FIGS. 4 is a half end view of the FIG. 2 boat hull along viewing plane 4—4.
Figure 9:
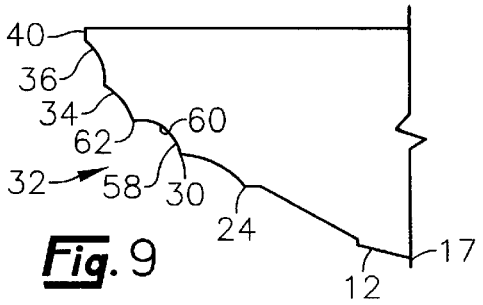
FIGS. 5–12 are half section views of the FIG. 2 boat hull along respective cutting plane stations.
Figure 5:
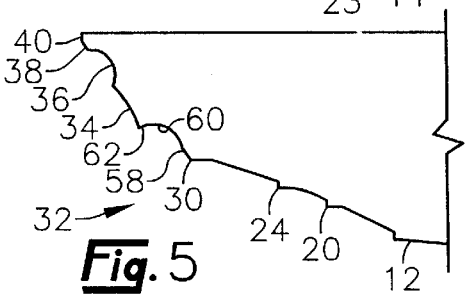
Figure 10:
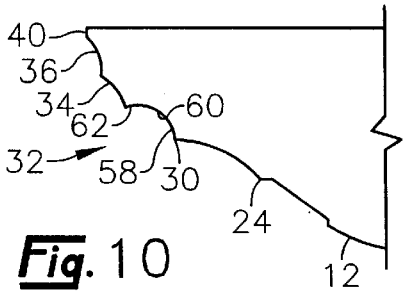

From the tunnel chines 32, side walls 34 and 36 extend upwardly and outwardly from the chine edge 62. As best shown in FIGS. 3, 4 and 5, the side walls 36 form aerodynamic wings along the aft section of the hull 1O to support and stabilize the hull at high speed. Toward the hull stem 108, the gunnel or uppermost edge of the hull is formed by beveled rail sections 38 and 40.

Referring now to the hull stem portion shown by FIGS. 3 and 4, an upper transom 42 rises rearwardly at an angle from a shallow V bottom offset 44 between a pair of laterally flanking after-sponsons 45. The lowermost surfaces 46 of the after-sponsons are disposed rearwardly and upwardly from the lower transom plane 13. Each after-sponson also includes a rear side wall 48 which is an extension of the side wall 34. Above the rear side wall 48 is a rear wall 56 which is an extension of the side wall 36.

A propulsion or drive unit cavity 50 is formed between the two after-sponsons 45 and aft of the upper transom 42. Interior walls 52 of the after-sponsons 45 are inclined slightly outwardly with respect to the cavity 50 to provide greater freedom of movement for an outboard motor or stern drive propulsion unit mounted on the upper transom 42. Lifting pads 53 are short, relatively narrow and concave surfaces extending from the lower transom 13 to shed water spray from the planing pad 12 and bottom panels 19 and 23 that would otherwise adhere to the after-sponson lower surfaces 46, 48 and 60.

Referring now to FIG. 4, a stern end view is shown of one-half of the hull from the vertical center plane 17 to the port side. Since the hull is substantially symmetrical with respect to the vertical center plane 17, the starboard half of the hull is a mirror image of the port half of the hull and is thus not shown. Intermediate lifting strakes 20, 24 and 30 are longitudinally disposed upwardly and outwardly from the planing pad 12. The tunnel chine 32 is disposed adjacent to the third intermediate lifting strake 30.

Referring to the half-station profiles of FIGS. 5–11, the planing pad 12 is substantially flat, horizontally and transversely along the intersection line with the transom. This flatness of the planing pad along the transom line diminishes progressively with a diminishing dihedral angle toward the boat bow. At the half-station of FIG. 11, an included V angle of about 120° is shown. In particular reference to FIGS. 8, 9 and 10, it will be appreciated that the planing pad V shape is rounded at the apex of the V so that the cross-sectional shape of the planing pad is a rounded point V. The rounding continues aft to the stem but the arc is substantially imperceptible.

Figure 6:
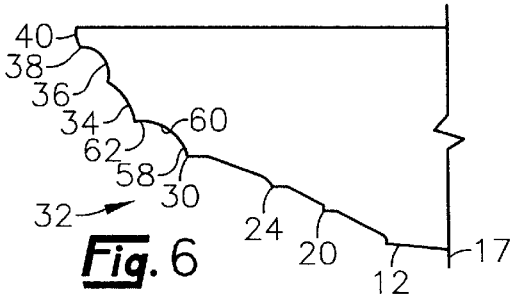
Figure 11:
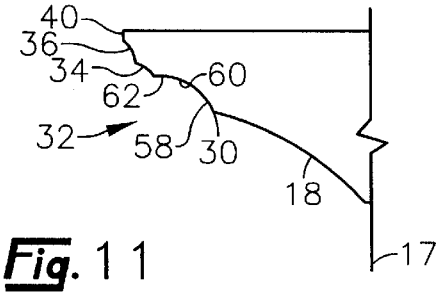
Figure 7:
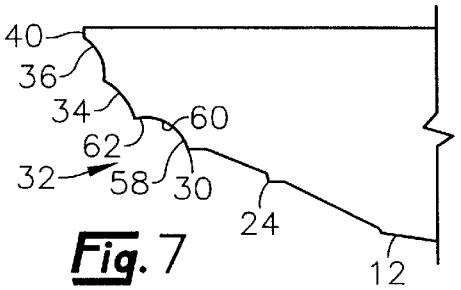
Figure 12:
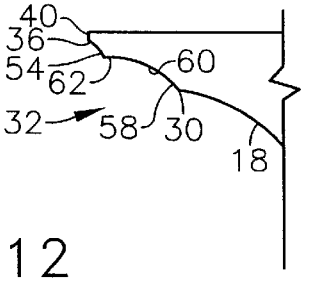
Figure 8:
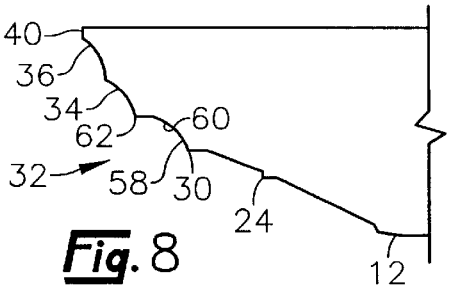

Referring to FIGS. 4, 5 and 6, it should be appreciated that along the aft one-third of the hull, the side wall 36 forms a wing gunnel similar in shape to the tunnel chines 32. The surfaces curve upwardly with respect a plane perpendicular to center plane 17 and function as wing forms that tend to lift and stabilize the stern at high speed. With particular reference to FIGS. 5 and 6, the outer edges of the wing gunnels formed by the wall 36 are lower than interior portions so that the air flow up from the hull bottom is trapped. Since the hull center of gravity is nearest the stern of the boat, the lift provided by the wing gunnels 36 is located adjacent the load. This added lift to the boat stem assists the dynamic transition to the planing attitude and biases a high speed planing attitude with a higher stern and lower bow.

As previously described, intermediate lifting strakes 20, 24 and 30 are aligned between the planing pad steps 14 and the tunnel chine 32. Hull bottom panel 19 separates the lifting strake 20 from the planing pad step 14. Bottom panel 23 separates the lifting strake 20 from the next strake 24. And, bottom panel 29 separates the first lifting strake 30 from the second strake 24.

Figure 13:
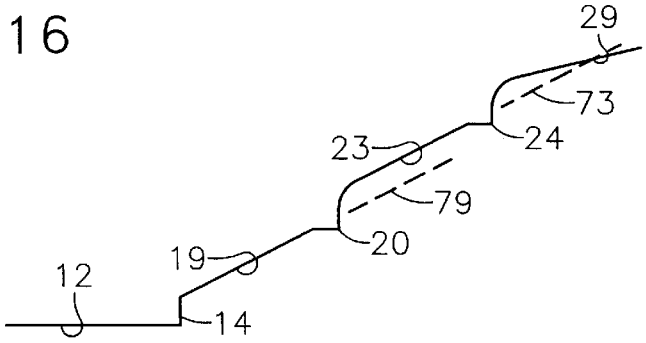
FIG. 13 is an enlarged profile of the FIG. 2 cutting plane station 5—5.

With respect to FIG. 13, which shows an enlargement of the hull half-section profile at about station 5, FIG. 2, an upwardly and outwardly projection 79 of the bottom panel 19 passes notably below the plane of the next outer panel 23. A projection 73 of the panel 23 plane intersects the plane of the outermost panel 29.

Figure 14:
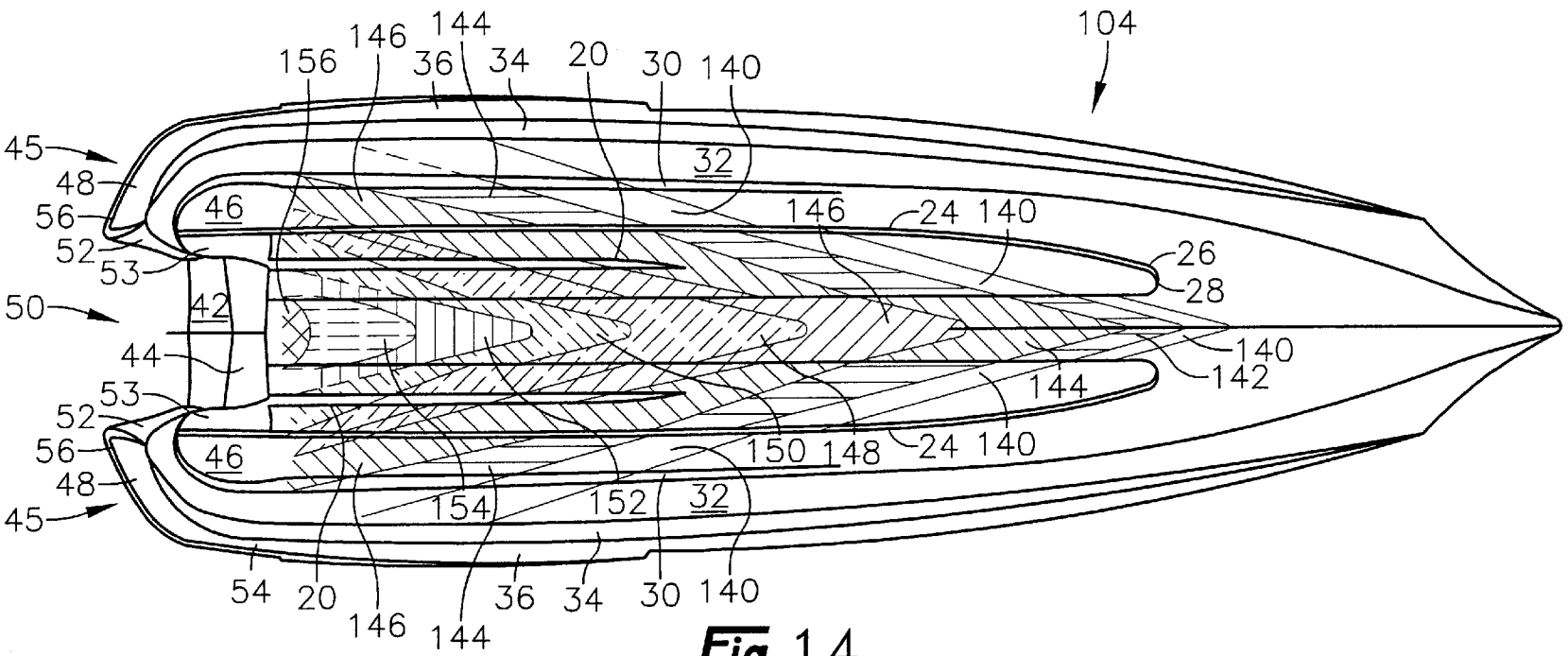
FIG. 14 is a bottom view of the boat hull with graphic representations of wet surface areas with respect to the speed of the boat.

The function of the hull 104 may be appreciated by reference to FIG. 14 which discloses the wetted surface of the hull 104 at various speeds. When the hull 104 is motionless in the water, the rearward portion of the tunnel chines 32 will be all or partially submerged below the water surface 106 while the front section of the tunnel chines 32 will be out of the water. As the hull 104 begins to move forward, that portion of the tunnel chines 32 that is submerged below water level will begin to function as a water wing and lift the boat with water pressure. As the water attempts to escape upwardly and outwardly from beneath the hull 104, it will impinge upon the curved wall 60 (FIGS. 4–12) and the chine edge 62 of the chines 32 thereby creating lift. Near the boat bow 110 where the chines 32 are out of the water, the spray from the boat will be deflected outwardly by the chines 32. The force of the water impinging on the chines will create additional lift. Because of the very efficient planing design of hull 104, planing will occur at about ten miles per hour and the wetted surface of the hull will be the approximate area shown in FIG. 14 as area 140 which extends toward the boat stern 108. At this speed, the tunnel chines 32 are below water level near the stem 108. As the boat continues to gain speed and begins to "plane off", the tunnel chines 32 are lifted substantially clear of the water surface. At twenty miles per hour, the wetted surface of the hull is within an area 142 extending toward the boat stern 108. At this speed, the tunnel chines 32 are lifted substantially completely out of the water. However, they are still deflecting spray away from the hull 104.

Figure 15:
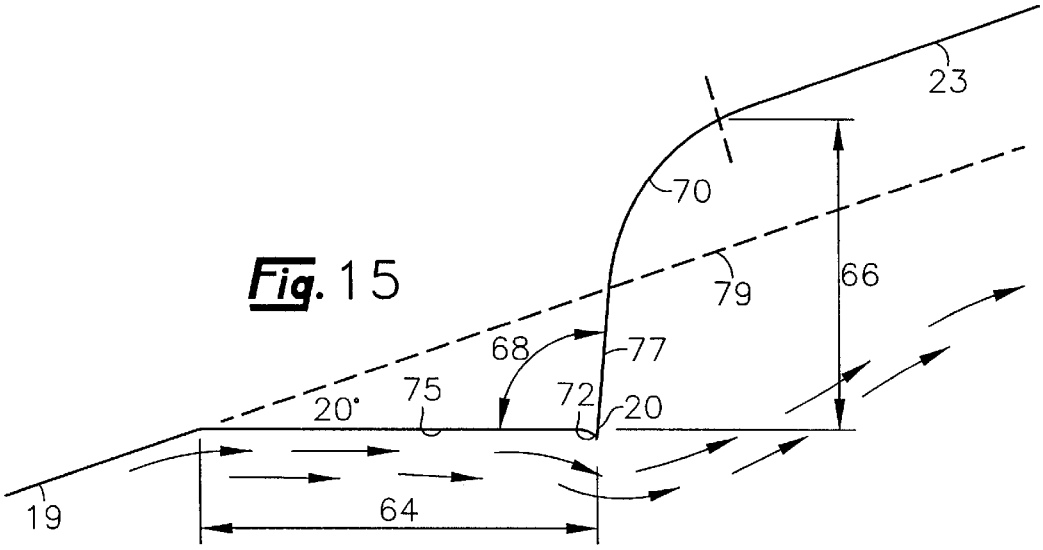
FIG. 15 is an enlarged detail of a boat lifting strake according to the invention.

As shown by FIG. 15, a common thread to this geometry woven into all of the intermediate lifting strakes is the width proportionality between the intermediate strake tread surface plane 75 and the riser face plane 77. The design objective is a tread plane width 64 of less than about 3 in. to minimize the fluid drag forces along this surface. Simultaneously, the width 66 of the riser surface 77, as measured to the point of fillet 70 tangency with the next higher bottom panel 23, for example, should be about 1 in. or greater. That portion of the riser height 66 above the planar projection of the lower bottom panel 19 is preferably coved with a smoothly faired fillet 70. Proximate of the boat stem, these proportions will provide a strake riser height of about 120% to about 200% greater than prior art strake designs.

The included angle 68 of these intermediate lifting strakes is preferably between about 95° to about 110°. It is also preferable to curl the corner edge of the strake with a lip 72 projecting downwardly about 1/16 in. below the horizontal surface.

These intermediate strake construction principles have proven effective for speed increases of approximately 5% to about 10% and greater improvements in fuel consumption rates at more modest speeds.

Without commitment to any particular theory by which the present invention may function to achieve the dramatic speed and efficiency gains noted, it is believed that a large percentage of such improvement results from an enhanced capacity of the present lifting strakes to shed the spray of laterally displaced water. With respect to the prior art strake construction shown by FIG. 16, the arrows represent the lateral and upward movement of water displaced by the boat hull. This displacement is highly energized by the sudden impact of the boat hull surfaces. Consequently, the displaced water has a high flow velocity and includes a longitudinal component along the hull length. As the flow rises onto the horizontal tread surface 94 of the prior art strake 90 a change in flow direction transfers additional lifting force to the boat hull. Still highly energized, the displaced water leaves the horizontal surface 94 along the strake edge 93 in an upwardly biased spray.

Figure 16:
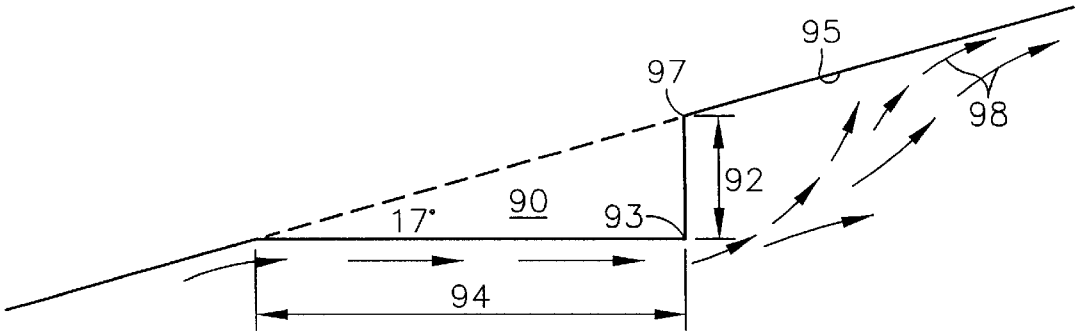
PRIOR ART Fig. 16
FIG. 16 is an enlarged detail of a prior art lifting strake on a 17° deadrise angle boat bottom.

Consistent with prior art strake construction, the strakes 90 are merely rail-like attachments to a continuous, 12° to 24° dead rise plane. The strake riser face 92 is narrow relative to the width of the horizontal planing surface 94. The 17° deadrise angle of FIG. 16 is typical. The quantity of energy extracted from the change of water flow direction across the horizontal surface 94 is relatively small. If the riser face 92 is less than about 1 in. sufficient energy remains to support a strong spray from the strake edge 93 onto the next upper bottom panel 95 as represented by the arrow point lines 98 of FIG. 16. Hence, when the prior art strake planing surface 94 is on or near the water body surface, the rising displacement water generates a spray from edge 93 that bridges onto the next higher bottom panel 95 that is already well above the water body surface.

Figure 17:
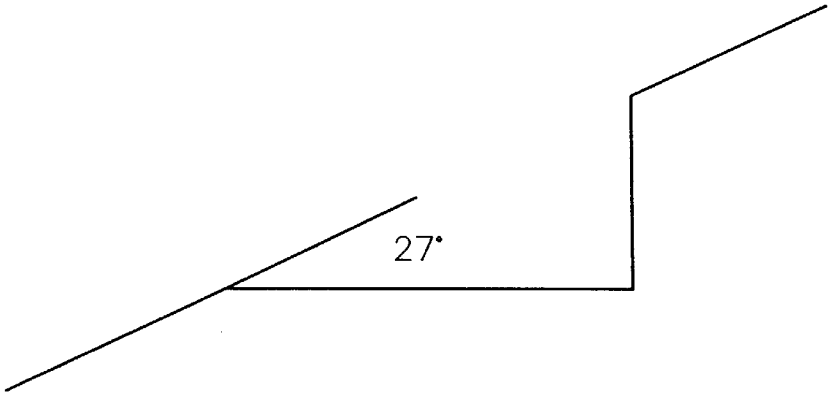
FIG. 17 is an enlarged detail of a hypothetical lifting strake on a 27° deadrise angle boat bottom.

A strake tread width 94 of about 1½ to about 2 in. is generally considered optimum. However, at a deadrise angle of 17°, a 2 in. tread width allows a riser 92 height of only about 0.61 in. On the other hand, a riser 92 height of 1 in. on a 17° deadrise angle requires a tread width 94 of about 3.33 in. Parasitic drag from a 3+ in. wide strake tread is generally considered excessive. A 0.50 rise: tread ratio as shown by FIG. 17 would require a deadrise angle of about 27° which is also generally considered to be excessive due to roll instability.

By minimizing the width of the present invention strake tread surfaces 75 as shown by FIG. 15, lateral flow velocity and energy of the displacement water across the strake tread surface is substantially terminated along the strake corner adjacent lip 72. As this rapidly moving water flow leaves the strake surface 75 over the strake corner, the small, down turned corner lip 72 gives the flow spray a turning bias down into the water body. Additionally, the relatively sharp edge of the lip 72 creates a sharp concentration of shearing forces in opposition to the fluid adhesion forces. Hence, the lateral flow of displacement water is biased and energized to drive itself away from the strake at the lip 72.

Figure 18:
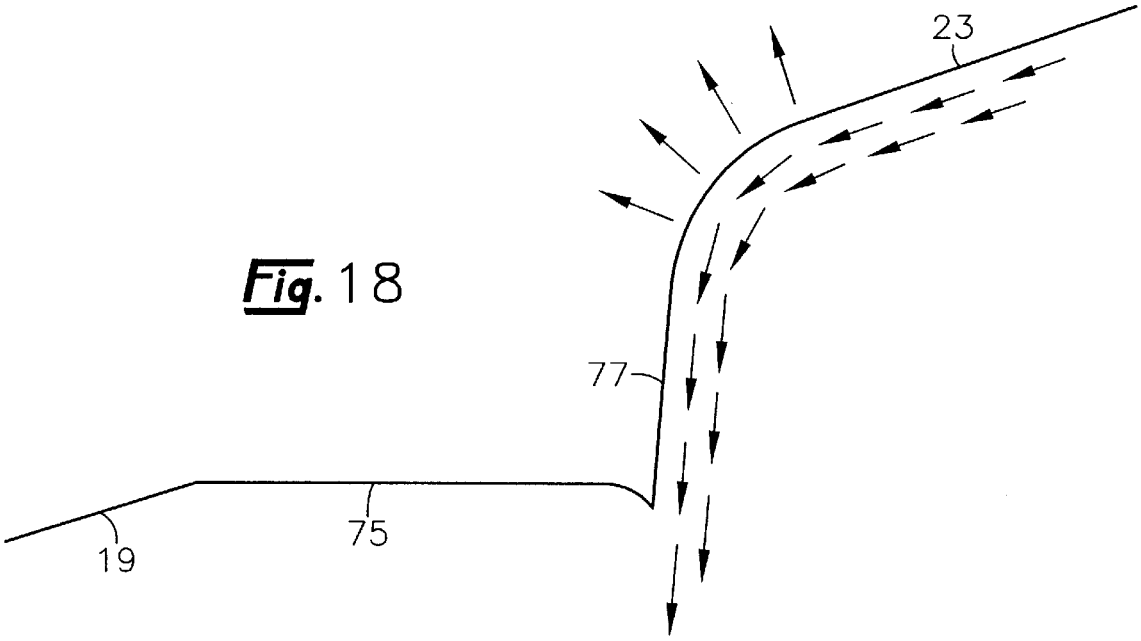
FIG. 18 is an enlarged detail of the present invention showing reverse flow vectors.

A surprising bonus from the fillet 70 fairing of the strake riser face 66 into the plane of the higher bottom panel 23 is greater side-slipping capacity. An extremely abrupt intersection of a wide riser face tends to produce a dangerous capacity for catestropic tumbling of the boat in the roll mode in the event of sudden turning maneuvers or being struck by large, laterally traveling waves. The strake fairing of the present invention, however, provides a controlled lifting response to strong lateral flows against the riser faces. As represented by the force and flow vectors of FIG. 18, this lifting response raises the hull in the water and reduces the lateral flow impact area. As a result of the lifting response provided by the strake fairing, the hull is proportionately released to dissipate the lateral impact load of the lateral flow in a harmless skid. An example of the foregoing explanation was demonstrated with that aforedescribed boat by execution of an approximately 180° turn about an approximately 50 ft. turning circle at 112 mph without capsizing or significant roll.

Returning to the water displacement patterns of FIG. 14, at thirty miles per hour, the wetted hull surface is reduced to area 144. The tunnel chines 32 at this speed are out of the water and spray but their lifting effect will continue as the air pressure beneath the boat increasingly provides an upward force on the tunnel chines 32. The main function of the tunnel chines 32 hereafter is to provide aerodynamic stability of the hull 104 at high speeds.

As the hull speed continues to increase, the hull 104 will ride increasingly higher in the water. At forty miles per hour the wetted surface is within area 146; at fifty miles per hour it is within area 148; at sixty miles per hour it is within area 150; at seventy miles per hour it is within area 152; at ninety miles per hour it is within area 154; and at one hundred ten miles per hour it is within area 156. At about seventy miles per hour, the hull 104 is riding entirely on the pad 12 with a portion of the stem 108 being exposed to a substantial amount of spray from the pad 12. Thus, when the hull is running at speeds in excess of seventy miles per hour, the aerodynamics of the hull become very important. At such speeds, the tunnel chines 32 and the rear portion of walls 36 will function as gull-wings and will tend to stabilize the hull. At high speeds, when the hull is riding on the back one or two feet of the planing pad 12, the water will provide very little roll stability; e.g. the boat may easily rotate about a longitudinal axis. The tunnel chines 32 and the wing gunnels formed by side walls 36, however, tend to resist this longitudinal rotation. When one side of the boat is raised and the other is lowered, the tunnel chines 32 and side walls 36 will be reoriented slightly and the upper or raised side will "spill air" and the lift on that side of the boat will be diminished. Conversely, the lift on the other side of the boat will be increased as the downward facing surface area of the chines 32 and side walls 36 increases and their air trapping capacity increases. The air trapping capacity of the chines 32 and walls 36 increases on the lower side of the boat because the outer edges of these structures are pointed more downwardly and they are, thus, better oriented to trap air as it spills off and up the hull. When viewed as a wing structure, the tunnel chines 32 and walls 36 provide a significant amount of stability and a tendency to resist rotation of the boat about a longitudinal axis.

When the hull 104 is traveling at a relatively high speed, and it hits a large wave, it will tend to "stick" in the wave as the wetted surface of the hull increases dramatically. The lift and spray deflection provided by the tunnel chines 32 will help lift the hull back out of the wave. In addition, a bubble or air space will form behind the curved shoulder 28 and between the stepped pad 12 and the strake 24. This bubble or air turbulence will decrease the wetted surface of the hull and will diminish the stopping effect that the wave has on the hull.

Also, when the hull is traveling at high speeds, wind and wave action will try to flip the boat over backwards. The after-sponsons 45 and the wing gunnels formed by walls 36 will resist this tendency. If the bow is raised, the boat will rotate about a transverse/horizontal axis at the back of the pad 12 (reverse pitch) and, thus, will rotate the after-sponsons 45 downwardly. Thus, the air pressure on the lower surface 46 of the after-sponson 45 will increase and will tend to force the front of the boat back down. Also, the attack angle of the wing gunnel of walls 36 against the wind will increase and the lift on the rear one-third of the hull increases rapidly. If the front of the boat continues to rotate upwardly, the after-sponsons 45 will begin to deflect spray and may strike the surface of the water. This action will slow the boat, which will tend to force the bow downwardly, and it will also impart a torque on the boat which will force the nose of the boat downwardly.

The after-sponsons 45 also provide improved hull performance at slower speeds. When the boat is still in the water, the after-sponsons, being near the rear of the boat and near the motor, float low in the water and function as pontoons to provide lateral stability for the boat. As the boat begins to move forward, the tapered design of the after-sponsons provide a streamlining effect for the boat and facilitates slow forward motion. This streamlining effect is useful if the hull is to be used as a fishing boat powered by a trolling motor.

As the boat begins to move faster and begins its transition to planing speeds, the after-sponsons 45 will act as after-planers behind the center of rotation of the hull and will force the nose of the boat downwardly and will cause the boat to plane more quickly. When the boat finally reaches planing speeds, the after-sponsons will be raised from the water and will not create unnecessary drag. At this point the streamlined shape of the after-sponsons 45 provides a twin benefit. The streamlining makes the boat move through the air with less drag thereby enabling higher speeds. Also, the streamlining of the after-sponsons 45 eliminates or greatly reduces a vacuum or turbulence effect behind the motor that often occurs near the transom causing the motor to breathe its own exhaust and to blacken the transom with exhaust residue.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. In particular, it will be understood that the length, width and various other dimensions of the hull 10 and the integral parts thereof may be scaled up or down in size or slightly varied without substantially changing the performance of the hull. All such modifications and variations are within the scope of the invention as determined by the appended claims when interpreted in accordance with breadth to which they are fairly, legally and equitably entitled.

As my invention, therefore,

I claim:

1. A boat having modified V-bottom hull surfaces and a transverse transom plane, bottom surfaces of said hull comprising:

a planing pad disposed substantially symmetrically about a vertical center plane of said boat to extend forwardly along said bottom surface from said transverse transom plane, said planing pad being laterally delineated on each side of said vertical center plane by elongated steps having riser faces spanning between a substantially horizontal bottom surface of said planing pad and respective first bottom panels disposed within respective first deadrise planes; and, a pair of intermediate lifting strakes extended forwardly along said bottom surface substantially from said transverse transom plane, said intermediate strakes having substantially planar tread surfaces emerging horizontally from a respective first bottom panel along lines laterally spaced from adjacent planing pad riser faces, said tread surfaces having a horizontal width terminated by a corner intersection with respective strake riser faces, said strake riser faces having an elongated width between said corner intersections and respective second bottom panels disposed within respective second deadrise planes; the width of said strake tread surface being about 3 in. or less and the width of said strake riser faces being about 1 in. or more whereby said first deadrise planes are substantially below said second deadrise planes in the proximity of said strake riser faces.

2. A boat as described by claim 1 wherein said corner intersection of said strake tread surface with said strake riser face has an included angle therebetween of about 95° to about 110°.

3. A boat as described by claim 1 wherein a fillet surface fairs a surface transition of a strake riser face into said second bottom panel.

4. A boat as described by claim 3 wherein the width of said strake riser face is substantially measured between said corner intersection and substantial tangency of said fillet surface with said second bottom panel.

5. A boat as described by claim 1 wherein said corner intersection comprises a downwardly turned curl.

6. A boat having modified V-bottom hull surfaces and a transverse transom plane, bottom surfaces of said hull comprising:

a planing pad disposed substantially symmetrically about a vertical center plane of said boat to extend forwardly along said bottom surface from said transverse transom plane, said planing pad being laterally delineated on each side of said vertical center plane by an elongated step having a riser face between the bottom surface of said planing pad and a first line of juncture with a respective first bottom panel, said first bottom panel extending from the first juncture line along a deadrise angle between about 12° to about 24°;

hull chine means substantially delineating respective lateral limits of said V-bottom hull surfaces; and, a lifting strake, disposed between said planing pad step and said hull chine means to extend forwardly along said bottom surface substantially from said transverse transom plane, said strake having a substantially planar tread surface emerging from the respective first bottom panel along a line laterally spaced from an adjacent planing pad riser face, said tread surface having a horizontal width of about 3 in. or less and terminated by a corner intersection with a respective strake riser face, said strake riser face having an elongated width between said corner intersection and a second line of juncture respective to a second bottom panel, the width of said strake riser face being about 1 in. or more.

7. A boat as described by claim 6 wherein said corner intersection of said strake tread surface with said strake riser face has an included angle therebetween of about 95° to about 110°.

8. A boat as described by claim 6 wherein a projection of a first plane that substantially coincides with said first bottom panel is substantially below a second plane that substantially coincides with said second bottom panel.

9. A boat as described by claim 8 wherein a fillet surface fairs a surface transition of said strake riser face into said second bottom panel.

10. A boat as described by claim 9 wherein the width of said strake riser face is substantially measured between said corner intersection and substantial tangency of said fillet surface with said second bottom panel.

11. A boat as described by claim 6 wherein said corner intersection comprises a downwardly turned curl.

12. A boat having modified V-bottom hull surfaces and a transverse transom plane, bottom surfaces of said hull comprising:

a planing pad disposed substantially symmetrically about a vertical center plane of said boat to extend forwardly along said bottom surface from said transverse transom plane, said planing pad being laterally delineated on each side of said vertical center plane by elongated steps having step riser faces spanning between substantially horizontal bottom surfaces and respective first bottom panels; and, a pair of intermediate lifting strakes extended forwardly along said bottom surface substantially from said transverse transom plane, each of said intermediate strakes having a substantially horizontal planar tread surface emerging from the respective first bottom panel along a line laterally spaced from an adjacent planing pad step riser face, said tread surface having a horizontal width terminated by a corner intersection with a substantially vertical strake riser face, said strake riser face having an elongated width between said corner intersection and an intersection with a respective second bottom panel; the width of said strake tread surfaces being about 3 in. or less, the width of said strake riser face being about 1 in. or more whereby a projection of a first plane that substantially coincides with said first bottom panel is substantially below a second plane that substantially coincides with said second bottom panel in the proximity of strake surface intersection with said second bottom panel .

13. A boat as described by claim 12 wherein said corner intersection of said strake tread surface with said strake riser face has an included angle therebetween of about 95° to about 110°.

14. A boat as described by claim 12 wherein a fillet surface fairs a surface transition of said strake riser face into said second bottom panel.

15. A boat as described by claim 14 wherein the width of said strake riser face is substantially measured between said corner intersection and substantial tangency of said fillet surface with said second bottom panel.

16. A boat as described by claim 12 wherein said corner intersection comprises a downwardly turned curl.

* * * * *